United States Patent [19]

Hintzen et al.

[11] 4,075,954

[45] Feb. 28, 1978

[54] DEVICE FOR MAKING BRAID OPENINGS IN CUTS OF GARMENTS

[75] Inventors: Peter Hintzen, Krickenbach; Erich Willenbacher, Karlsruhe, both of Germany

[73] Assignee: Pfaff Industriemaschinen GmbH, Germany

[21] Appl. No.: 748,227

[22] Filed: Dec. 7, 1976

[30] Foreign Application Priority Data

Dec. 11, 1975 Germany ..... 2555753

[51] Int. Cl.[2] ..... D05B 3/10

[52] U.S. Cl. ..... 112/68; 112/130

[58] Field of Search ..... 112/68, 65, 130, 129, 112/122, 124; 83/905, 918

[56] References Cited

U.S. PATENT DOCUMENTS

| | | | |
|---|---|---|---|
| 259,840 | 6/1882 | Fowler | 112/129 |
| 3,847,097 | 11/1974 | Dusch et al. | 112/68 |
| 3,848,554 | 11/1974 | Kropf | 112/130 |
| 3,930,453 | 1/1976 | Hintzen et al. | 112/68 |

FOREIGN PATENT DOCUMENTS

| | | | |
|---|---|---|---|
| 27,790 | 11/1903 | Switzerland | 112/122 |

*Primary Examiner*—H. Hampton Hunter
*Attorney, Agent, or Firm*—McGlew and Tuttle

[57] ABSTRACT

A two-needle sewing machine includes a machine casing having a sewing head mounting the needles, a work support plate, and a ripping knife supported in the sewing head and working between the needles to form an elongated slot of a braid opening in a cut garment piece. A supporting bar is guided in the machine casing for longitudinal displacement perpendicular to the work support plate, and is rotatable into different angular positions. A single angular cross-section cutting knife is mounted on the supporting bar and serves as a tool for making diverging corner cuts at the opposite ends of the elongated slot. Air-operated piston-cylinder actuators are provided to rotate the supporting bar between two positions spaced angularly by 180°, and to displace the supporting bar longitudinally to effect the diverging corner cuts. The sewing head mounts a sliding foot arrangement for moving the work in a direction opposite to the normal work feeding direction.

7 Claims, 7 Drawing Figures

82
87
86
80
88
81
83
89
90
93
84
64
91
60
78
62
1
79
85
92
77
66
59
68
70
75
76
65
61
63
67
69
7
2
8
3
4
71
72
9
10
V
73
74
13
6
R
W
15
5
15
14
20
21
26
29
27
28
25
48
45
22
24
50
47
19
23
16
38
37

8
9
10
13
4
4
R
R
12
11
6
L
P

V
N
VII
W
B
A
D
C
P
R
F
R
E
B
A
L
D
C
N
VII

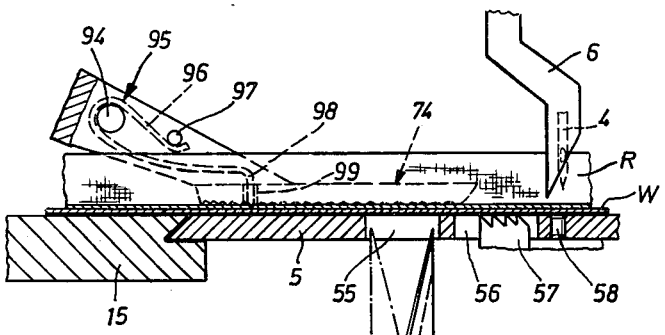
Fig.2
Fig.5
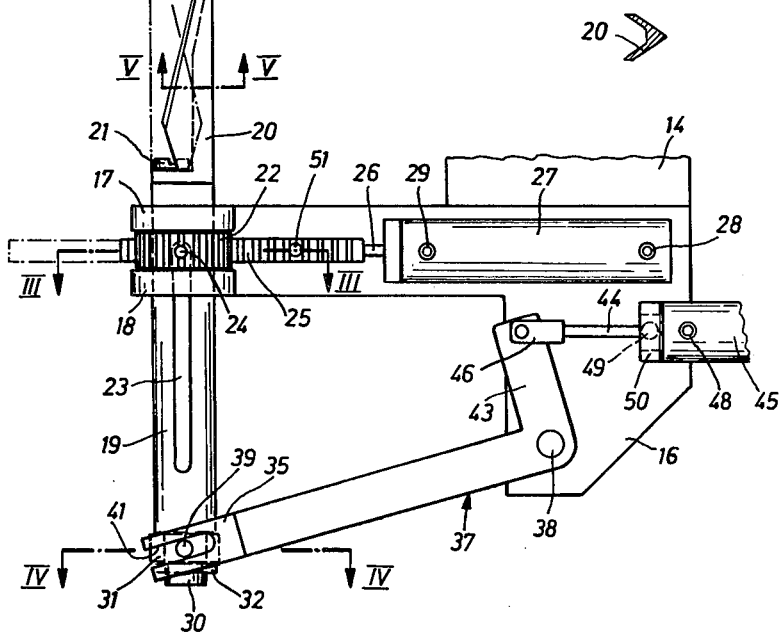
Fig.3
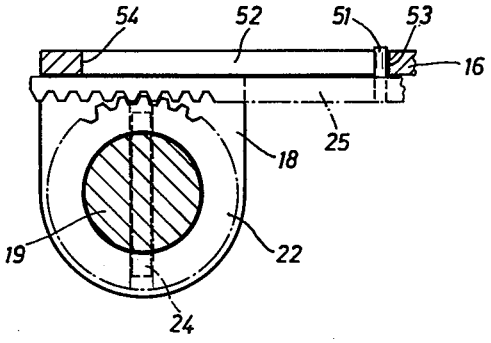
Fig.4
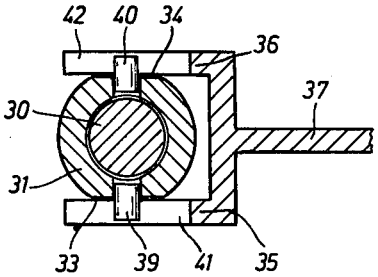

DEVICE FOR MAKING BRAID OPENINGS IN CUTS OF GARMENTS

FIELD AND BACKGROUND OF THE INVENTION

This invention relates to devices for making braid openings in cut garment pieces on a two-needle sewing machine having a ripping knife, for forming the elongated slot of the braid opening, working between the needles, and having means for making the diverging corner cuts at the opposite ends of the elongated slot. More particularly, the present invention is directed to an improved means for making the diverging corner cuts.

DESCRIPTION OF THE PRIOR ART

In known devices of this type, such as shown in DOS No. 2,037,726 and U.S. Pat. No. 3,745,545, the cutting tools, for making the corner cuts at the ends of the elongated slot of the braid opening, are arranged in spaced relation to the stitch-forming point and on a common carrier under the work support plate. After the sewing is completed and the elongated slot is cut open, the sewing material must be moved through the sewing material clamps to the corner cutting station and be stopped, positioned exactly above the angle cutting knives, before the latter are activated. If braid openings of different sizes are to be produced, the spacing of the cutting tools and the stopping positions of the sewing material clamps, determined by stops, must be readjusted in each case, which results in lost time and interruptions in the work process.

In order to avoid these disadvantages, it has been suggested, in U.S. Pat. No. 3.814,037, to arrange the angle cutting knives on cutting blocks which can be coupled individually with the sewing material clamps, which are displaceable relative to the stitch-forming point, and which are entrained, by the associated sewing material clamp, into their cutting positions, which depend on the length of a tab which also determines the length of the braid opening. The cutting knives are returned into their starting positions after the corner cuts have been made. The relatively elaborated coupling device and the guiding device for the cutting blocks increase the costs of the device quite considerably.

U.S. Pat. No. 3,738,292 discloses a device where the angle cutting knives can be controlled individually. One knife can thus make the first corner cut during the sewing operation. However, the work support plate must be specially designed to accommodate the angle cutting knives. Thus, the sewing machine cannot be tilted, in the machine stand, about the conventional hinge pins, which is also true of the sewing machines of the previously mentioned devices, in such a way that the underside of the work support plate is accessible, such as is desirable for maintenance work.

SUMMARY OF THE INVENTION

The invention is directed to a solution to the problem of designing a device, for making corner cuts, by means of which the corner cuts can be made at both opposite ends of the elongated slot of the braid opening using only a single angle cutting knife, or a cutting knife having an angular cross-section. In accordance with the invention, this problem is solved in that there is used a single angle cross-section cutting knife as a cutting tool for the corner cuts, this knife being arranged on a supporting bar guided, in the machine casing, for longitudinal displacement and rotatable into different angular positions.

Due to the use of a single angle cross-section cutting knife, the corner cutting means can be so compact and arranged under the work support plate of the sewing machine in such a way that the angle cross-section cutting knife works in the range of the stitch-forming point. With this arrangement, long displacements of the sewing material, before the formation of the second corner cut, are avoided, and the device can be installed without any difficulties in any sewing machine suitable for making braid openings and in such a way that the sewing machine can be tilted about the hinge pins in the machine stand, for maintenance work, for example, and need not be lifted out of the machine stand.

The angle cross-section cutting knife can be brought, with simple means and great accuracy, into the angular positions necessary for making the corner cuts, if the supporting bar is connected with a gear whose displacement end positions, which can be fixed by preferably adjustable stops, determine the various angular positions of the angle cutting knife for forming the corner cuts. Due to the adjustability of the stops, angular positions of the angle cross-section cutting knife, for straight braid openings or for openings extending obliquely to the seam edge, can be fixed by simple means.

In accordance with another feature of the invention, an index ring, which is provided with two diametrically opposite flat surfaces and is ebraced by a U-shaped end portion of a driving lever, can be rotatably mounted on the supporting bar, this ring having two diametrically opposite lugs projecting into fork guides of the end portion. The design an guidance of the index ring permits the rotation of the supporting bar while maintaining the form-locking driving connection between a driving lever and the supporting bar, and offers the possibility of compensation in the transmission of the linear movement from the pivotally mounted driving lever to the supporting bar.

In order to secure the supporting bar against rotation, and to assure its straight guiding, the supporting bar has a guide slot extending parallel to its longitudinal axis and engaged by a guide pin secured to the gear wheel.

An object of the invention is to provide an improved device for making braid openings in cut garment pieces on a two-needle sewing machine.

Another object of the invention is to provide such a device in which the corner cuts can be made at opposite ends of the elongated slot of the braid opening with only a single angle cross-section cutting knife.

A further object of the invention is to provide such a device in which the angle cutting knife can be brought with simple means and great accuracy, into the angular positions necessary for making the corner cuts.

For an understanding of the principles of the invention, reference is made to the following description of a typical embodiment thereof as illustrated in the accompanying drawings.

BRIEF DESCRIPTION OF THE DRAWINGS

In the Drawings:

FIG. 2 is an elevation view, partly in section and to a larger scale, showing the means for making the corner cuts with a part of the cloth shifting means;

FIG. 3 is a section along the line III—III of FIG. 2, on a even larger scale;

FIG. 4 is a section along theline IV—IV of FIG. 2, on the same scale as FIG. 3;

FIG. 5 is a section along the line V—V of FIG. 2;

DESCRIPTION OF THE PREFERRED EMBODIMENT

Figure 1:
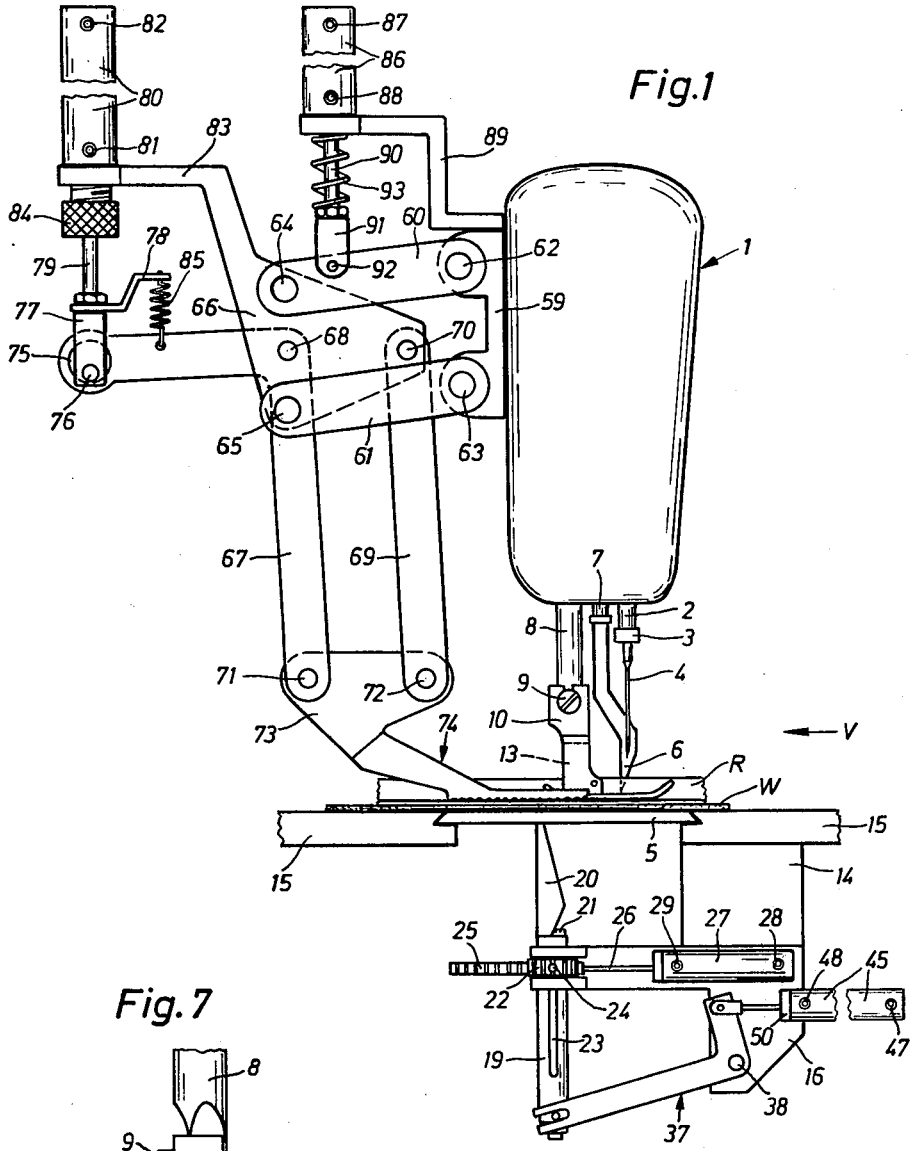
FIG. 1 is an elevation view of a device embodying the invention, showing the sewing head of a twoneedle sewing machine with a ripping knife working between the needles, an upper cloth shifting means, and the invention means for making the corner cuts.
Figure 7:
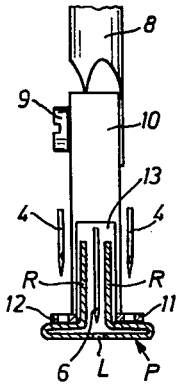
FIG. 7 is a sectional view taken along the line VII—VII of FIG. 6, and illustrating the presser foot of the sewing machine.

Referring first to FIG. 1, the illustrated sewing machine 1 is a commercial two-needle sewing machine with a needle holder 3 carrying two spaced needles 4 and secured on a vertically reciprocable needle bar 2. Needles 4 cooperate with respective loopers (not shown) arranged under a stitch plate 5, for the formation of two independent seams N, shown in FIG. 6. A ripping knife 6 works between needles 4 to form the elongated slot L, shown in FIGS. 6 and 7, and is secured on a knife bar 7 which can be longitudinally displaced in the casing of sewing machine 1 and which can be coupled, in a known manner, with a constantly driven swing lever. In the casing of sewing machine 1, there is also arranged a vertically displaceable and resiliently pre-stressed presser bar 8 which bears, by spring action, on the sewing material resting on stitch plate 5. By means of a screw 9, a presser foot 10, with two sole parts 11 and 12, is secured on presser bar 8, and has a passage 13, as shown in FIG. 7, for the raised edges R of braid strip P to be sewn on cut garment piece W and between which ripping knife 6 works.

Figure 6:
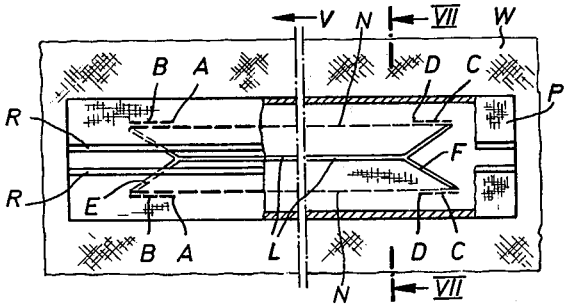
FIG. 6 is a partial plan view of a cut garment piece with a sewn-on braid strip, elongated slot and the corner cuts at the opposite ends of the slots.

On a post or mounting plate 14 of work support plate 15 of sewing machine 1, there is secured a supporting plate 16, shown in FIGS. 1 and 2, for the cutting device for making the corner cuts E and F, shown in FIG. 6. The free left end of supporting plate 16 is forked and has two bored arms 17 and 18, as best seen in FIG. 2. A supporting bar 19 extends through the bores of arms 17 and 18, for rotation and longitudinal displacement. An angle cross-section cutting knife 20 is secured to the upper end of supporting bar 19 by means of a screw 21. A gear 22 is arranged on supporting bar 19 and is held and guided between arms 17 and 18 of supporting plate 16, and supporting bar 19 has a guide slot 23 extending parallel to its longitudinal axis and in which there is engaged a guide pin 24 secured in gear 22. A rack 25 meshes with gear 22 and is secured on piston rod 26 of a compressed air cylinder 27 having connections 28 and 29.

The bottom end of supporting bar 19 has a journal 30 whose diameter is smaller than that of bar 19, and journal 30 rotatably mounts an index ring 31, shown in FIGS. 2 and 4, and which is secured against axial displacement by a safety ring 32. Index ring 31 is formed with two flat surfaces 33 and 34 serving as guide surfaces and embraced by arms 35, 36 of the forked end of a swing lever 37 which is pivotally mounted on supporting plate 16 for pivoting about a bolt or pin 38. Two pins, 39 and 40, are secured in index ring 31 at diametrically opposite locations, and engage guide slots 41 and 42, respectively, of arms 35 and 36, respectively.

Swing lever 37 is an angle lever having a bent end 43 to which is articulated a fork 46 secured on piston rod 44 of a compressed air cylinder 45 which has connections 47 and 48, as shown in FIG. 1, and which is mounted, by means of a mounting ring 50 provided with a journal 49 and rotatably received in supporting plate 16, for pivotal movement about journal 49.

A stop pin 51, shown in FIGS. 2 and 3, is pressed, with a press-fit, into rack 25, and engages an elongated slot 52 in supporting plate 16, and the end faces 53 and 54 (FIG. 3) of slot 52 form counter-stops for stop pin 51. Instead of the end faces 53 and 54 of an elongated slot 52 serving as counter-stops, adjustable stop cams could be provided on supporting plate 16 in the path of motion of stop pin 51 in order to enable adjustment and fixing of the end positions of rack 25 and the angular positions, defined by it, of angle cross-section cutting knife 20 secured on supporting bar 19.

Stitch plate 5 of sewing machine 1 has a recess 55, shown in FIG. 2, and through which angle cross-section cutting knife 20 is pushed upward to make the corner cuts E and F, shown in FIG. 6. Stitch plate 5 also has a slot 56, shown in FIG. 2, for the passage of the toothed webs of a cloth feed 57 of sewing machine 1 performing a rectilinear movement, and is formed with stitch holes 58 for needles 4. It should be mentioned that cloth feed 57 can displace the sewing material by shifting a known stitch adjustor, both in the feeding direction, indicated by arrow V, and in the opposite direction, for example, in order to lock the seams N at the beginning and at the end, these seams having been formed during displacement of the sewing material in the feeding direction V.

Since only the first corner cut E can be made with the above-described corner cutting means during the sewing operation, it is necessary to bring the sewing material, after the completion of the sewing operation, that is, after the seams N have been locked, by sewing several stitches C, shown in FIG. 6, in the displacement direction opposite to the feeding direction V, and after the threads have been cut off, so over the angle cross-section cutting knife 20, before the second corncer cut is made, that the second corner cut F is made at the correct point of the elongated slot L.

For this purpose, there is used a device which has a carrier 59, shown in FIG. 1, secured on the back of the machine casing and on which are arranged two parallel guide rods 60 and 61 for rotation about pivots 62 and 63. At the opposite ends of the parallel guide rods 60, 61, and intermediate plate 66 is articulated thereto by pivots 64, 65. An angle lever 67 is arranged on intermediate plate 66 for swinging about a pivot 68 which is spaced from a pivot 70 for a guide rod 69. Angle lever 67 and guide rod 69 are articulated, by means of pivots 71, 72, respectively, on a shaft or web 73 of a sliding foot 74 arranged to engage the sewing material.

At the free end of angle lever 67, there is formed a bore 75 through which there passes a follower pin 76 secured on a fork 77 embracing the free end of lever 67. The diameter of bore 75 is substantially greater than the diameter of pin 76 so that angle lever 67 can be moved relative to fork 77. Fork 77, together with a suspension plate 78, is secured on piston rod 79 of a compressed air cylinder 80 having connections 81 and 82 and which is mounted on a supporting arm 83 of intermediate plate 66. In order to change the stroke of piston rod 79, an adjusting nut 84 is screwed into the cylinder of air cylindeer 80, and the piston rod 79 extends through nut 84. A tension spring 85 is connected between suspension plate 78 and the free end of angle lever 67 to form an elastic coupling connection between the angle lever and its driving means, namely, the compressed air cylinder 80.

To raise and lower sliding foot 74, there is provided a compressed air cylinder 86 having connections 87 and 88 and which is arranged on a supporting angle 89 secured on carrier 89. A fork 91 is secured on piston rod 90 of compressed air cylinder 86 and embraces guide rod 60 to which it is connected by a pin 92. Between fork 91 and supporting angle 89, there is arranged a compression spring 93 embracing piston rod 90.

In order to ensure the entrainment of sliding foot 74 in the sewing material, during its movement for locking the seams N at the end, the underside of the sole of sliding foot 74 is toothed. Additionally, several hairpin springs 95 are provided on sliding foot 74 and have their bights engaged over retaining pins 94, as shown in FIG. 2, in sliding foot 74. Only one spring 95 is shown in FIG. 2, and has an end 96 bearing on a pin 97 in sliding foot 74 as well as a downwardly bent end resiliently pre-stressed toward the sewing material on passing through a bore 99 in sliding foot 74.

Sewing machine 1, its various parts, and the compressed air cylinders 27, 45, 80 and 86 are controlled by a known program device utilizing electromagnetic valves, with a measuring wheel, equipped with Hall generators, for scanning the workpiece and serving as a pulse transmitter for the control commands to be transmitted to the workpiece through an amplifier, the measuring wheel cooperating with stationary permanent magnets. The measuring wheel can be arranged, for example, on the cloth presser bar of the sewing machine. Starting from the consideration that a cut garment piece W with a braid strip P fed through a folding sleeve and folded into an inverted T-form is under pressure foot 10 at a point where the locking seams B start, namely, the point A of FIG. 6, and that angle cutting knife 20 is under stitch plate 5 in an annular position for the corner cut E, shown in solid lines in FIG. 6 and determined by stop pin 51 and the end face 53 of elongated slot 52, sliding foot 74 is lifted from the sewing material, ripping knife 6 is retracted and the measuring wheel is in contact with the sewing material, the device works in a manner which will now be described. With the electric program device activated, the motor driving the sewing machine is started by a starting switch and drives sewing machine 1, at first, at a reduced speed until after the first corner cut E has been made, by displacing the sewing material in a direction opposite to the feeding direction V. A few locking stitches B are formed, starting at the point A after which the sliding direction of the work is reversed and the sewing material is displaced to form the seams N, in the direction of arrow V. At a point provided for this purpose, ripping knife 6, working between the edges R (FIG. 7) of braid strip P is activated and, during the sewing, cuts the elongated slot L in braid strip P and in cut garment piece W.

With the sewing machine still operating at a reduced speed, the first corner cut E is made during the sewing by supplying compressed air to compressed air cylinder 45 through connection 48, so that supporting rod 19 is pushed upwardly through the medium of index ring 31 and angle lever 37. The angle cross-section cutting knife 20 passes through recess 55 in stitch plate 5 and makes the corner cut E. Then, the supply of compressed air to connection 48 is interrupted, and the cylinder is exhausted, after which compressed air is supplied through connection 47 so that supporting bar 19 with angle cross-section knife 20 is retracted again into the starting position. Supporting bar 19, with angle knife 20, is then turned through 180° to the angular position indicated by broken lines in FIG. 2, for the preparation of the second corner cut F. This is effected by supplying compressed air to cylinder 27 through connection 28 and, in the end position for the second corner cut F, stop pin 55 secured in track 25 bears on end face 54 of slot 52.

Sewing machine 1 can now be driven at a higher speed. Ripping knife 6 is retracted or disconnected after cutting slot L to the required length and at the point provided for the second corner cut F, the sewing machine speed is reduced again and seams N are completed until the desired seam length is obtained. As soon as that point is reached where the sliding direction of the sewing material must be reversed for the formation of the end locking stitches C of the seams N, sliding foot 74 is lowered abruptly onto sewing material P and W through compressed air cylinder 86 to which compressed air is supplied through its connection 87, and sliding foot 74 is held pressed against the sewing material, after exhausting of compressed air cylinder 86, by compression spring 93. In the following displacement of the sewing material in a direction opposite to the feeding direction V for the formation of end locking stitches C, sliding foot 74 is taken along by the sewing material up to the seam end D and tension spring 85 is tensioned. The entrainment of sliding foot 74 by the sewing material is made possible by the substantially large diameter of bore 75 in angle lever 67, relative to the diameter of follower pin 76, thus providing what may be termed a lost motion connection.

In the last upward movement of needle bar 2, the threads are cut off, pressure foot 10 is lifted from the sewing material, and sewing maching 1 is stopped with the needles at the upper position. By supplying air to air cylinder 80 through connection 81, angle lever 67 is turned, through follower pin 76, about pivot 68 in plate 66 until fork 77, secured on piston rod 79, bears on adjusting nut 84. By providing the parallel guide rod 69 between plate 66 and shaft or web 73 of sliding foot 74, the latter is displaced when angle lever 67 is actuated with the sewing material in the feeding direction V, into a position determined by adjusting nut 84 and fork 77 in which the sewing material is, together with the end of the elongated slot L above angle cross-section cutting knife 20, which has been turned, in the meantime, through 180° about the axis of supporting bar 19 into the angular position shown in FIG. 2 by broken lines. By a corresponding supply of compressed air over connections 47 and 48 of air cylinder 45, supporting bar 19, with cutting knife 20, is then pushed briefly upward through angle lever 37 and index ring 31 to make the second corner cut F, is returned into the starting position, and the cutting knife is angularly displaced in the opposite direction for making the next corner cut E on a new workpiece by supplying compressed air through connection 29 of air cylinder 27, the rotation being through 180° into the angular position shown in solid lines in FIG. 2 and determined by pin 51 engaging end face 53 of elongated slot 52.

Slidng foot 74 is then lifted from the sewing material by supplying compressed air through connection 88 to air cylinder 86, so that the sliding foot 74 is lifted from the sewing table and a new workpiece is made ready under presser foot 10, aligned according to optical markings, and a braid strip, folded in inverted T-form can be supplied, after which the above-described cycle can be started again after presser foot 10 has been lowered.

While a specific embodiment of the invention has been shown and described in detail to illustrate the application of the principles of the invention, it will be understood that the invention may be embodied otherwise without departing from such principles.

What is claimed is:

1. In a two-needle sewing machine including a machine casing having a sewing head mounting the needles, a work support plate, a ripping knife supported in the sewing head and working between the needles to form an elongated slot of a braid opening in a cut garment piece, and means for making diverging corner cuts at the opposite ends of the elongated slot, an improved device for forming the braid opening comprising, in combination, a supporting bar guided in the machine casing for longitudinal displacement perpendicular to the work support plate and rotatable into different angular positions; a single angular cross-section cutting knife mounted on said supporting bar and serving as a tool for making said diverging corner cuts; and means operable to effect longitudinal and rotational displacement of said supporting bar and said cutting knife.

2. In a two-needle sewing machine, the improved device claimed in claim 1, in which said supporting bar and said cutting knife are so arranged beneath said support plate of said sewing machine that said cutting knife works in the range of the stitch-forming point of said sewing machine.

3. In a two-needle sewing machine, the improved device claimed in claim 1, said rotatable means including means operable to locate said supporting bar and said cutting knife between two positions spaced 180° apart, with said cutting knife, in each position, being angularly oriented to make the diverging corner cuts at a respective one of the opposite ends of said elongated slot.

4. In a two-needle sewing machine, the improved device claimed in claim 3, including a gear secured to rotate with said supporting bar; said rotating means including a rack meshing with said gear; and stop means cooperable with said rack to limit the rectilinear displacements of said rack to determine the respective angular positions of said supporting bar and said cutting knife for the two corner cuts.

5. In a two-needle sewing machine, the improved device claimed in claim 4, including means providing for axial displacement of said supporting bar axially of said gear while restraining relative rotation of said supporting bar and said gear.

6. In a two-needle sewing machine, the improved device claimed in claim 5, in which said means restraining relative rotation of said supporting bar and said gear while providing for relative axial displacement thereof comprises a guide slot formed through said supporting bar diametrically thereof and extending parallel to the longitudinal axis of said supporting bar; and a guide pin secured to said grear wheel and extending through said slot.

7. In a two-needle sewing machine, the improved device claimed in claim 1, in which said means operable to effect longitudinal displacement of said supporting bar and said cutting knife comprises an index ring secured to said supporting bar and formed with two diametrically opposite first surfaces; a driving lever pivotally mounted intermediate its ends, and having a U-shaped end portion forming a fork embracing said index ring with the legs of said fork engaging respective flat surfaces of said index ring; each leg of said fork having an outwardly opening guide slot formed therein; said index ring having diametrically opposed lugs engageable in said guide slots.

* * * * *